US009506306B2

(12) United States Patent
Nikiforuk

(10) Patent No.: US 9,506,306 B2
(45) Date of Patent: Nov. 29, 2016

(54) CASING FILLING TOOL

(71) Applicant: TESCO CORPORATION, Houston, TX (US)

(72) Inventor: Kevin James Nikiforuk, Houston, TX (US)

(73) Assignee: TESCO CORPORATION, Houston, TX (US)

( * ) Notice: Subject to any disclaimer, the term of this patent is extended or adjusted under 35 U.S.C. 154(b) by 676 days.

(21) Appl. No.: 13/954,531

(22) Filed: Jul. 30, 2013

(65) Prior Publication Data

US 2015/0034302 A1 Feb. 5, 2015

(51) Int. Cl.

| | |
|---|---|
| ***E21B 21/10*** | (2006.01) |
| ***E21B 21/14*** | (2006.01) |
| ***E21B 41/00*** | (2006.01) |
| ***E21B 33/04*** | (2006.01) |
| ***E21B 34/06*** | (2006.01) |
| ***E21B 43/10*** | (2006.01) |

(52) U.S. Cl.

CPC ..... *E21B 21/106* (2013.01); *E21B 21/10* (2013.01); *E21B 21/14* (2013.01); *E21B 33/0422* (2013.01); *E21B 34/06* (2013.01); *E21B 41/00* (2013.01); *E21B 43/10* (2013.01)

(58) Field of Classification Search

CPC ..... E21B 21/10; E21B 21/106; E21B 33/126
See application file for complete search history.

(56) References Cited

U.S. PATENT DOCUMENTS

| | | | | |
|---|---|---|---|---|
| 2,295,803 A | 9/1942 | O'Leary | | |
| 3,887,342 A | 6/1975 | Bunnelle | | |
| 5,501,280 A * | 3/1996 | Brisco | E21B 21/10 | 166/324 |
| 6,382,317 B1 * | 5/2002 | Cobb | E21B 43/38 | 166/105.5 |
| 2002/0096334 A1 | 7/2002 | LaFleur | | |
| 2005/0000695 A1 | 1/2005 | LaFleur | | |
| 2013/0306318 A1 * | 11/2013 | Frosell | E21B 41/02 | 166/305.1 |

OTHER PUBLICATIONS

AutoSeal II Fill-Up and Circulation Tools. Weatherford. Tubular Running Services, 2011. http://www.weatherford.com/dn/WFT164381.

Davis Fill and Circulate Tool. Davis Davis-Lynch, Inc. Aug. 16, 2009. http://www.wyomingcasingservice.com/docs/Davis-Lynch%20Fill%20Tool.pdf.

International Search Report & Written Opinion for International Application No. PCT/US2014/046186 mailed Mar. 19, 2015.

* cited by examiner

*Primary Examiner* — Jennifer H Gay
*Assistant Examiner* — George Gray
(74) *Attorney, Agent, or Firm* — Fletcher Yoder, P.C.

(57) ABSTRACT

A system includes a tubular filling tool. In certain embodiments, the tubular filling tool includes a conductor pipe configured to receive a filling fluid flow from a top drive and a diffuser block communicatively coupled to the conductor pipe and configured to receive the filling fluid flow from the conductor pipe, wherein the diffuser block includes a plurality of fluid passages extending to external passages formed in an outer diameter of the diffuser block and configured to facilitate passage of the filling fluid flow to the external passages from within the diffuser block, wherein the external passages are configured to generate a swirl flow pattern in the filling fluid flow during a tubular filling process.

19 Claims, 4 Drawing Sheets

CASING FILLING TOOL

BACKGROUND

The present disclosure relates generally to the field of drilling and processing of wells, and, more particularly, to a system and method for filling casing during a casing process, a drilling process, or another type of well processing operation.

In conventional oil and gas operations, a well is typically drilled to a desired depth with a drill string, which includes drill pipe and a drilling bottom hole assembly. Once the desired depth is reached, the drill string is removed from the hole and casing is run into the vacant hole. Casing may be defined as pipe or tubular that is placed in a well to prevent the well from caving in, to contain fluids, and to assist with efficient extraction of product. Tubular may be defined as including drill pipe, casing, or any other type of tubular utilized in drilling or well processing operations.

During drilling and casing running operations, a string of tubular (e.g., drill pipe or casing) is typically held by slips mounted to the rig floor while a new length of tubular is connected. Specifically in casing operations, a new length of tubular is positioned above the floor mounted tubular string by a special elevator while connections are made up at the rig floor level. Occasionally, as the string of tubular is assembled at the surface, the string of tubular may be filled with a filling fluid (e.g., mud or water) to provide balance to the string of tubular, to flush drilling material out of the wellbore, and so forth. Alternatively, the string of tubular may be filled after the string of tubular is "floated" or landed in the hole. Unfortunately, the filling process can be lengthy, thereby increasing the costs associated with the filling process. However, increasing the speed of filling the string of tubular with the filling fluid can undesirably lead to aeration of the filling fluid. Accordingly, it is now recognized that there exists a need for a system for increasing the speed of the filling process, while reducing aeration in the filling fluid during the filling process.

BRIEF DESCRIPTION

In accordance with one embodiment of the present disclosure, a tubular filling tool includes a conductor pipe configured to receive a filling fluid flow from a top drive and a diffuser block communicatively coupled to the conductor pipe and configured to receive the filling fluid flow from the conductor pipe, wherein the diffuser block comprises a plurality of fluid passages extending to external passages formed in an outer diameter of the diffuser block and configured to facilitate passage of the filling fluid flow to the external passages from within the diffuser block, wherein the external passages are configured to generate a swirl flow pattern in the filling fluid flow during a tubular filling process.

In another embodiment, a method includes receiving a filling fluid into a filling tool of a mineral extraction system, passing the filling fluid through a conductor pipe to a diffuser block, generating a swirl flow pattern in the filling fluid with the filling tool by passing the filling fluid through fluid passages of the diffuser block and into external passages arranged in a helical pattern, and flowing the filling fluid into a tubular of the mineral extraction system.

In a further embodiment, a drilling system includes a tubular filling tool, a conductor pipe of the tubular filling tool configured to receive a filling fluid from a filling fluid pump, and a diffuser block of the tubular filling tool coupled to the conductor pipe, a plurality fluid passages in the diffuser block communicatively extending from the conductor pipe to external passages formed in an outer diameter of the diffuser block, wherein the external passages are configured to generate a swirl flow pattern in the filling fluid during a tubular filling process, and a plurality of blades extending radially outward from the conductor pipe about a circumference of the conductor pipe and spaced along a length of the conductor pipe.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Embodiments of the present disclosure are directed toward a filling tool for filling casing or other tubular with a filling fluid. More specifically, during a filling process associated with running or landed casing, a filling tool may be used to increase the speed of filling the casing or tubular with filling fluid. Additionally, the filling tool may be configured to reduce aeration of the filling fluid during the filling process and/or separate entrained filling fluid from air exiting the casing during the filling process.

As discussed in detail below, in one embodiment, the filling tool includes a conductor pipe that flows filling fluid to a diffuser block of the filling tool. Thereafter, the diffuser block generates a swirl, vortex, or other helical flow pattern in the filling fluid as the filling fluid enters the casing or tubular. In this manner, the filling fluid may more completely travel downward against an inner diameter of the casing or tubular, thereby reducing aeration of the filling fluid within the casing or tubular during the filling process. Additionally, the diffuser may include an air chamber configured to collect or gather air exiting the casing or tubular during the filling process and direct the air across stationary blades positioned about the conductor pipe. In the manner described below, the turbine stator blades may reduce entrained fluid (e.g., filling fluid) within the air exiting the casing or tubular as the casing or tubular is filled with the filling fluid.

Figure 1:
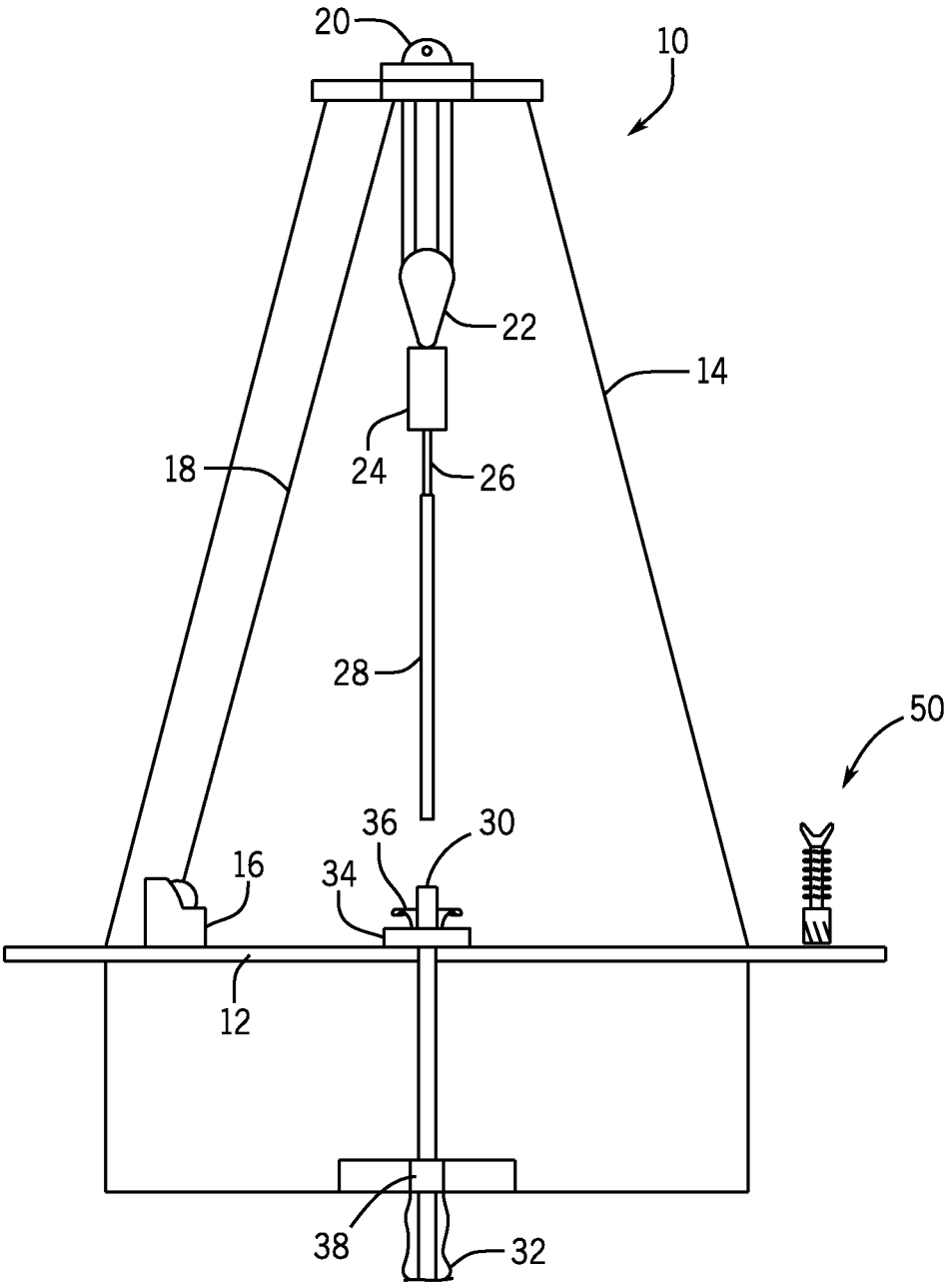
FIG. 1 is a schematic representation of a well being drilled, in accordance with an embodiment of the present technique.

Turning now to the drawings, FIG. 1 is a schematic representation of a drilling rig 10 in the process of drilling a well, in accordance with embodiments of the present techniques. The drilling rig 10 features an elevated rig floor 12 and a derrick 14 extending above the floor. A drawworks 16 supplies drilling line 18 to a crown block 20 and traveling block 22 in order to hoist various types of drilling equipment above the rig floor 12. The traveling block 22 supports a top drive 24, which is connected to a casing drive system 26, which are used to make connections with tubular lengths 28 as they are added to the tubular 30 that extends into the wellbore 32. The tubular length 28 can include either a length of casing or drill pipe, and the tubular 30 is the total length of connected casing or drill pipe that extends into the wellbore 32 at a given moment. Once a connection has been made between a new tubular length 28 and the tubular 30 at the rig floor level, the tubular length 28 effectively becomes part of the tubular 30.

While a new tubular length 28 is being attached to the tubular 30, the tubular 30 is held stationary with respect to the rig floor 12 by a rotary table 34 and slips 36. The tubular 30 extends below the rig floor 12 and through a blow-out preventer 38 before extending into the wellbore 32 at the ground level. After the tubular 30 is landed in the wellbore 32, a tubular filling process may be completed. More specifically, the tubular filling process includes flowing a filling fluid (e.g., mud or water) into the tubular 30 and the wellbore 32. As will be appreciated, the tubular 30 filling process may help balance the tubular 30 within the wellbore 32 and flush up drilling material (e.g., rock, dirt, debris, etc.) created during the drilling process.

In the present embodiments, a filling tool 50 may be used to improve the tubular 30 filling process. As discussed in detail below, the drilling tool 50 may be configured to reduce aeration in the filling fluid as the filling fluid is pumped into the tubular 30. Additionally, the filling tool 50 may be configured to reduce entrainment of filling fluid in air exiting the tubular 30 during the tubular 30 filling process. It should be noted that FIG. 1 is merely a representative embodiment. Certain features of FIG. 1 may be different in other embodiments.

While the filling tool 50 is not in active use in FIG. 1, it should be noted that the drilling rig 10 illustrated in FIG. 1 is intentionally simplified to focus on aspects of well operation related to the filling tool 50 described in the present disclosure. In FIG. 1, the filling tool 50 is not in active use. Rather, it is positioned for ready access by the casing drive system 26 for use in a casing or tubular 30 filling process. Many other components and tools may be employed during the various periods of formation and preparation of the wellbore 32. Similarly, as will be appreciated by those skilled in the art, the environment of the wellbore 32 may vary widely depending upon the location and situation of the formations of interest. For example, rather than a surface (land-based) operation, the wellbore 32 may be formed under water of various depths, in which case the topside equipment may include an anchored or floating platform, and some of the components used may be positioned at or near a point where the well enters the earth at the bottom of a body of water. Specifically, for example, the blow-out preventer 38 may be positioned on an ocean bottom when the drilling rig 10 is a component of an offshore platform.

Figure 2:
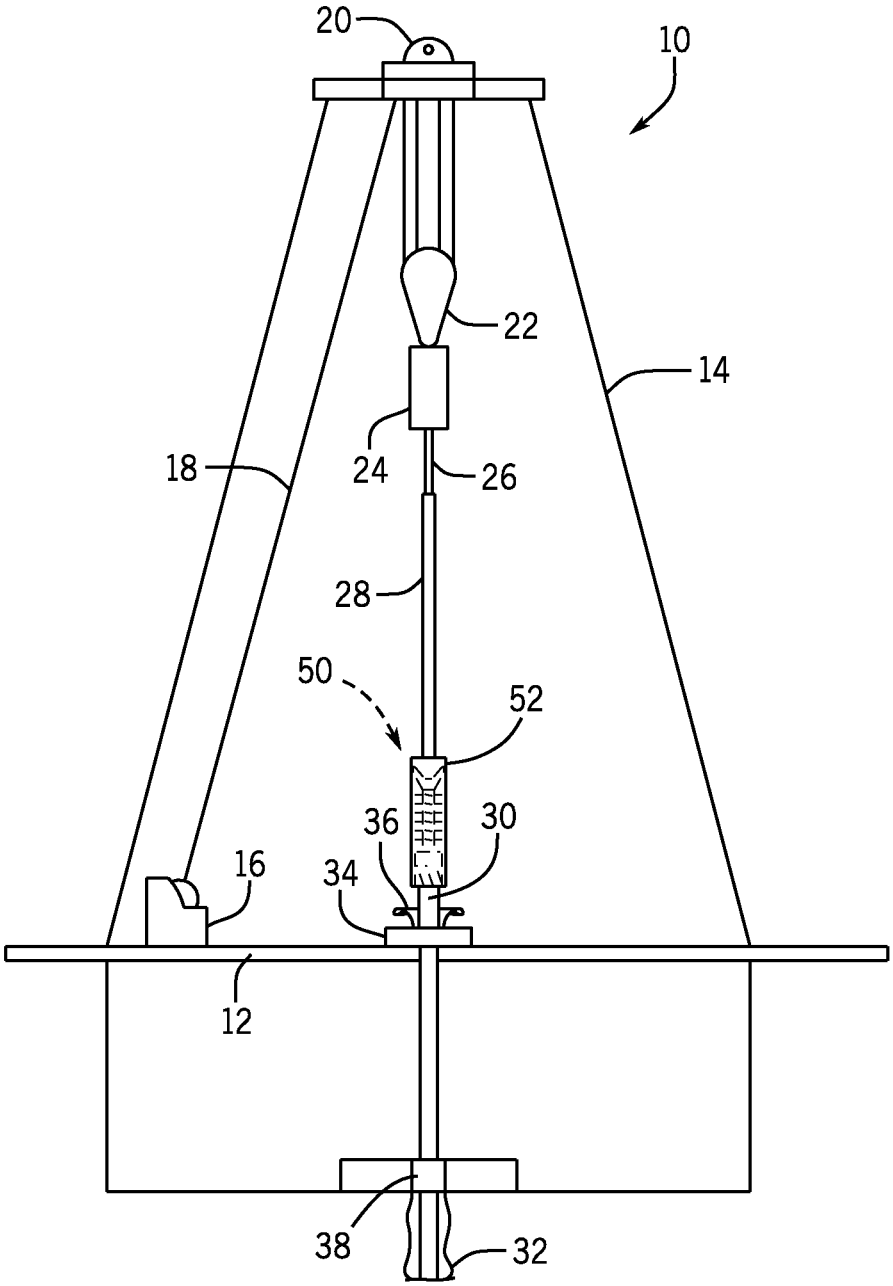
FIG. 2 is a schematic representation of a system configured to perform a casing filling process with a filling tool, in accordance with an embodiment of the present technique.

FIG. 2 is a schematic representation of the drilling rig 10 completing a tubular (e.g., casing) filling process with the filling tool 50, in accordance with embodiments of the present disclosure. Like FIG. 1, FIG. 2 is also simplified to focus on aspects associated with the filling tool 50. As mentioned above, the filling tool 50 may increase the speed at which a filling fluid may be run into the tubular 30, while also reducing aeration of the filling fluid and reducing fluid entrainment in air exiting the tubular 30 during the tubular filling process. After the tubular 30 is landed in the wellbore 32, the casing drive system 26 may couple to the filling tool 50 and position the filling tool 50 over and axially on top of the tubular 30. However, in other embodiments, the filling tool 50 may be coupled to and/or positioned in place (e.g., over and axially on top of the tubular 30) by other components, such as a hose, drill pipe, crossover, cementing head, or other component. As discussed below, in certain embodiments, the filling tool 50 may be positioned inside a length of casing 52 before being positioned axially on top of the tubular 30. Thereafter, a filling fluid (e.g., mud or water) is run through the filling tool 50 and into the tubular 30. In other embodiments, the filling tool 50 may be positioned axially on top of the tubular length 28 while the tubular length 28 is run into the wellbore 32. As such, the filling process may be completed while the tubular length 28 is run into the wellbore 32. As described in detail below, the filling tool 50 is configured to increase the speed at which the filling fluid may be run into the tubular 30 my generating a swirl, vortex, or other helical flow pattern with the filling fluid. In this manner, the filling fluid may more completely travel downward against an inner diameter of the casing or tubular, thereby reducing aeration of the filling fluid (e.g., by creating and/or increasing a surface tension between the filling fluid and an inner diameter of the tubular 30). Additionally, the filling tool 50 may include a plurality of stator blades configured to reduce entrained filling fluid in air exiting the tubular 30 as the filling process is completed.

Figure 3:
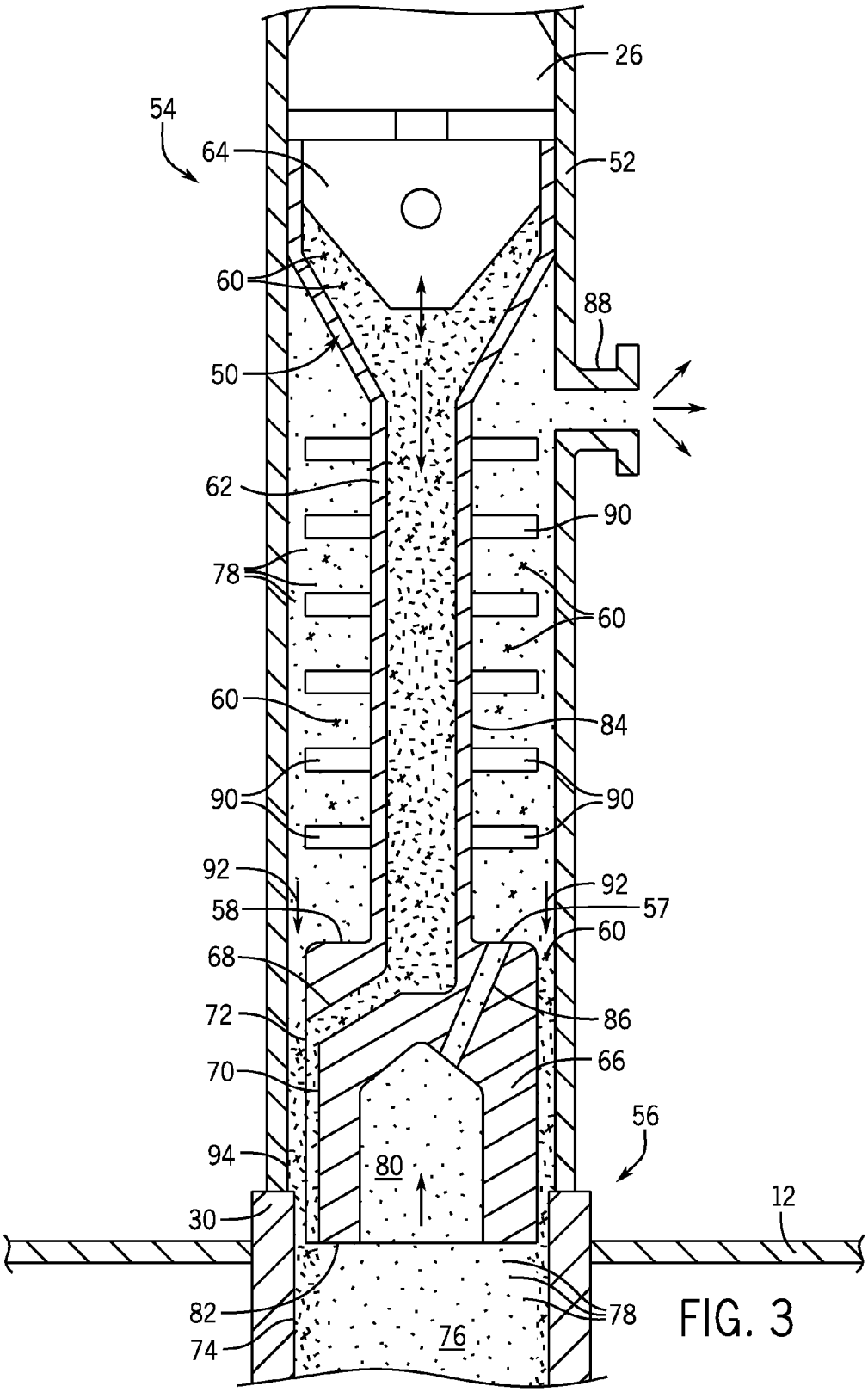
FIG. 3 is a schematic cross-sectional side view of a filling tool, in accordance with an embodiment of the present technique.

FIG. 3, which is a schematic of the filling tool 50 of FIG. 2, illustrates features that may enable a filling fluid 60 to be more quickly run into the tubular 30. As mentioned above, the filling tool 50 may be positioned within the length of casing 52. Subsequently, the filling tool 50 is gripped by the casing drive system 26 (e.g., by a threaded connection or other coupling mechanism) at a casing drive system end 54 of the filling tool 50 and positioned axially on top of the tubular 30 landed within the wellbore 32. Once the filling tool 50 is positioned above the tubular 30 landed in the wellbore 32, a filling fluid 60 is pumped into the filling tool 50. More specifically, the filling fluid 60 (e.g., mud or water) may be supplied and pumped by a mud pump or a centrifugal pump through the casing drive system 26 and into a conductor pipe 62 of the filling tool 50. In certain embodiments, a packer cap 64 of the casing drive system 26 may be positioned against the conductor pipe 62 of the filling tool 50.

As shown, the filling fluid 60 flows down the conductor pipe 62 toward the tubular 30 until it reaches a diffuser block 66 of the filling tool 50. The diffuser block 66 includes a plurality of filling fluid passages 68 extending from the conductor pipe 62 to an outer diameter 70 of the diffuser block 66. That is, the filling fluid passages 68 exit the diffuser block 66 at exit ports 72 formed in the outer diameter 70 of the diffuser block 66. As such, the diffuser block 66 routes the filling fluid 60 from the conductor pipe 62 of the filling tool 50 to the outer diameter 70 of the filling tool 50. As discussed in detail below, the outer diameter 70 of the diffuser block 66 may further include external passages (e.g., external passages 100 shown in FIG. 4) formed in the diffuser block 66. More particularly, an external passage (e.g., recess, perimeter passage, etc.) may extend from each of the exit ports 72 along the outer diameter 70 of the diffuser block in a helical, vortex, or swirl pattern. As a result, the filling fluid 60 may develop a helical, vortex, or swirl flow pattern along the outer diameter of the filling tool 50.

In the illustrated embodiment, the filling tool 50 extends partially into the tubular 30. Specifically, the length of casing 52 within which the filling tool 50 is positioned axially abuts the tubular 30 landed in the wellbore 32, and a portion of the diffuser block 66 of the filling tool 50 partially extends into the tubular 30. As such, the outer diameter 70 of the diffuser block 66 is coaxial and overlapping with an inner diameter 74 of the tubular 30. For example, the gap or space between the outer diameter 70 of the diffuser block 66 and the inner diameter 74 of the tubular 50 may be approximately 0.125 to 0.375 inches. As the filling fluid 60 exits the exit ports 72 and flows along the external passages of the diffuser block 66, the filling fluid 60 flow may transfer from the outer diameter 70 of the diffuser block 66 to the inner diameter 74 of the tubular 30. Furthermore, the helical, vortex, or swirl flow pattern of the filling fluid 60 may transfer from the outer diameter 70 of the diffuser block 66 to the inner diameter 74 of the tubular 30. As a result, surface tension created between the filling fluid 60 and the inner diameter 74 of the tubular 30 may cause the filling fluid 60 to flow more completely and laminarly along the inner diameter 74 as the filling fluid 60 flows into the tubular 30. Additionally, the helical, vortex, or swirl flow pattern of the filling fluid 60 may create a Coriolis Effect (e.g., an artificial Coriolis Effect) and/or a centripetal force acting on the filling fluid 60, which may also cause the filling fluid 60 to more completely flow along the inner diameter 74 of the tubular 30. In this manner, aeration of the filling fluid 60 within the tubular 30 may be reduced.

Furthermore, as the filling fluid 60 flows downwardly along the inner diameter 74 of the tubular 30, what may be referred to as a void 76 may be created towards a center of the tubular 30. As will be appreciated, air 78 displaced by the filling fluid 60 within the tubular 30 may collect in the void 76 and travel upward through the tubular 30 and toward the filling tool 50. As shown, the diffuser block 66 includes a chamber 80 formed in a bottom surface 82 of the diffuser block 66 (e.g., at a tubular 30 engagement end 56 of the filling tool 50). As shown, when the filling tool 50 is engaged with the tubular 30, the chamber 80 is exposed to the interior of the tubular 30. As the air 78 is displaced upward by the filling fluid 60 within the tubular 30, the air 78 may collect within the chamber 80 of the diffuser block 66. From the chamber 80 of the diffuser block 66, the air 78 is directed toward an outer diameter 84 of the conductor pipe 62 by a plurality of air passages 86 formed in the diffuser block 66. When the air 78 displaced from the tubular 30 reaches exit ports 57 of the air passages 86 formed in a shelf 58 (e.g., an upper shelf) of the diffuser block 66, the air 78 may continue to flow upward between the filling tool 50 and the length of casing 52 disposed about the filling tool 50 toward an exit air vent 88 formed in the length of casing 52. From the exit air vent 88, the air 78 may enter the atmosphere.

As shown, the filling tool 50 also includes a plurality of fins or blades 90 disposed about the conductor pipe 62. That is, the blades 90 extend radially outward from the outer diameter 84 of the conductor pipe 62. As the air 78 travels across the stationary blades 90, the blades 90 guide the air 78 to create a cyclone or swirl effect with the air 78. In other words, the air 78 may swirl around the conductor pipe 62 of the filling tool 50. Additionally, as the air 78 travels across the blades 90 and around the conductor pipe 62, the blades 90 may cause filling fluid 60 entrained in the air 78 to fall out of the air 78. As indicated by arrows 92, entrained filling fluid 60 that falls out of the air 78 may fall downwardly between the outer diameter 70 of the diffuser block 66 and an inner diameter 94 of the length of casing 52. As the length of casing 52 and the tubular 30 axially abut one another, filling fluid 60 that falls between the outer diameter 70 of the diffuser block 66 and an inner diameter 94 of the length of casing 52 may continue to flow downward between the inner diameter 74 of the tubular and the outer diameter 70 of the diffuser block 66, thereby rejoining the filling fluid 60 exiting the filling fluid passages 68 of the diffuser block 66 and flowing into the tubular 30.

Figure 4:
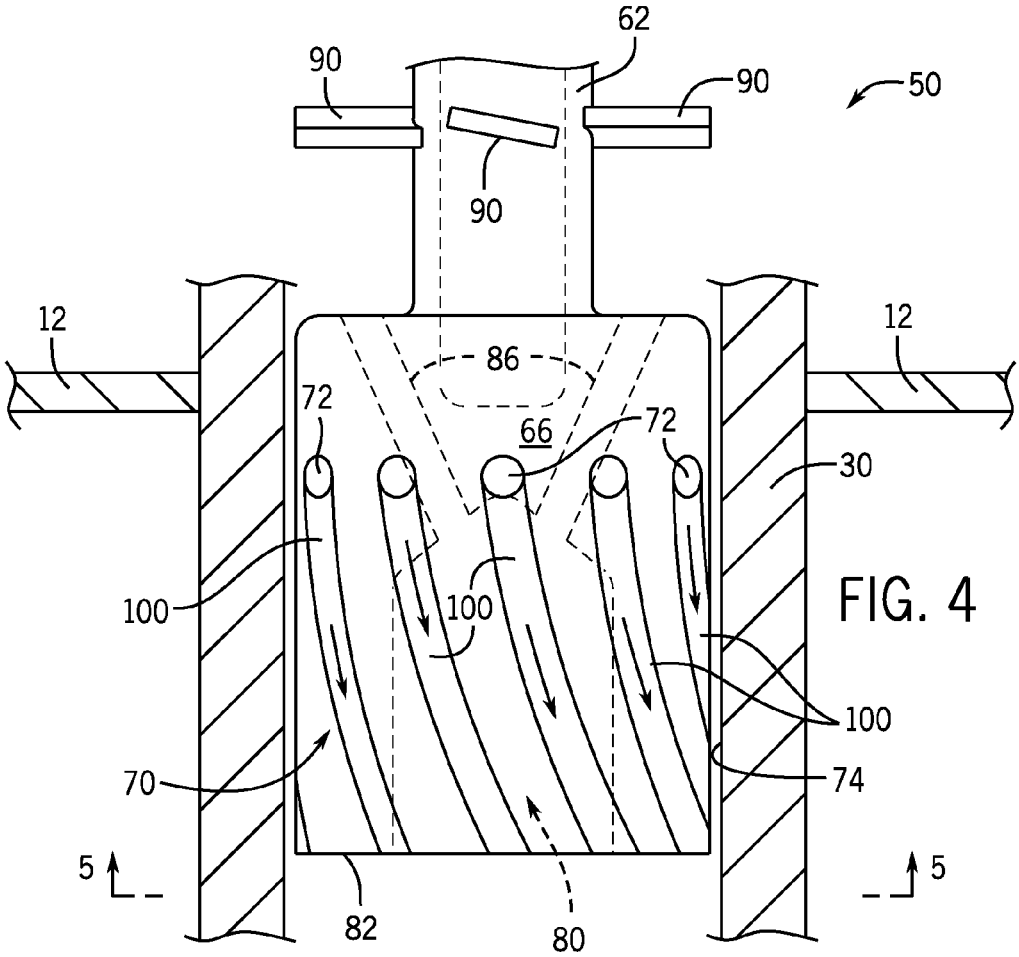
FIG. 4 is a schematic partial side view of a filling tool, in accordance with an embodiment of the present technique.

FIG. 4 is a schematic partial side view of the filling tool 50, illustrating the diffuser block 66 of the filling tool 50, in accordance with an embodiment of the present technique. In the illustrated embodiment, the diffuser block 66 extends entirely into the tubular 30. As mentioned above, the diffuser block 66 includes fluid passages 68 that extend from the conductor pipe 62 to exit ports 72 formed in the outer diameter 70 of the diffuser block 66. Additionally, external passages 100 are formed in the outer diameter 70 of the diffuser block 66 (e.g., by a milling process). More specifically, as shown, the external passages 100 extend from each of the exit ports 72 in a helical, vortex, or swirl pattern about the outer diameter 70 of the diffuser block 66. As a result, when the filling fluid 60 exits the diffuser block 66, the filling fluid 60 may travel through the external passages 100, thereby generating a helical, vortex, or swirl flow of the filling fluid 60. In the manner described above, the helical, vortex, or swirl flow of the filling fluid 60 enables the filling fluid 60 to flow more completely along the inner diameter 74 of the tubular 30, thereby reducing aeration of the filling fluid 60 as the filling fluid 60 fills the tubular 30 and increasing the speed at which the filling fluid 60 may be pumped into the tubular 30.

Figure 5:
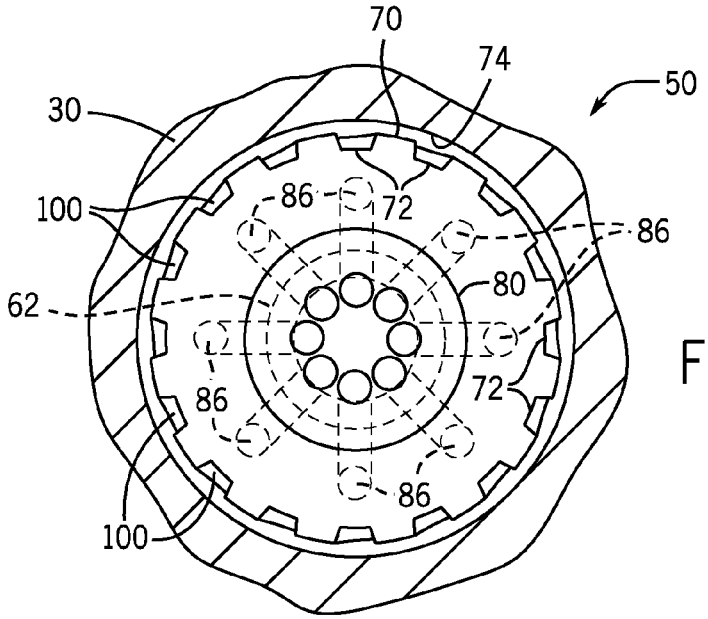
FIG. 5 is a schematic bottom view, taken alone line 5-5 of FIG. 4, of a filling tool, in accordance with an embodiment of the present technique.

FIG. 5 is a schematic bottom view, taken along line 5-5 of FIG. 4, illustrating the diffuser block 66 of the filling tool 50. As discussed in detail above, the diffuser block 66 includes external passages 100 formed in the outer diameter 70 of the diffuser block 66. Specifically, the external passages 100 extend from each of the exit ports 72 of the diffuser block, and the external passages 100 are arranged in a helical, vortex, or swirl pattern about the outer diameter 70 of the diffuser block 66. As a result, as the filling fluid 60 exits the diffuser block 66 through the exit ports 72, the filling fluid 60 may follow a helical, vortex, or swirl flow pattern and maintain that pattern into the tubular 30. Indeed, this flow pattern of the filling fluid 60 may be further transferred to the inner diameter 74 of the tubular 30, thereby creating a surface tension between the filling fluid 60 and the inner diameter 74 of the tubular 30. As a result, the filling fluid 60 may more completely flow against the inner diameter 74 of the tubular 30 as the filling fluid 60 flows downwardly into the tubular 30. In this manner, aeration of the filling fluid 60 may be reduced as the filling fluid 60 fills the tubular 30, and the speed at which the filling fluid 60 may be pumped into the tubular 30 may be increased.

Furthermore, as discussed in detail above, the diffuser block 66 includes the chamber 80 formed in the bottom surface 82 of the diffuser block 66. The chamber 80 collects air 78 displaced from the tubular 30 as the tubular 30 is filled with the filling fluid 60. From the chamber 80, the air 78 is directed to the outer diameter 84 of the conductor pipe 62 by air passages 86 formed in the diffuser block 66. In certain embodiments, the air passages 86 may be configured to direct the air 78 in a helical flow pattern. For example, the air passages 86 may be formed in the diffuser block 66 in helical arrangement. Additionally, each of the air passages 86 may have a helical or curved contour within the diffuser block 66. Moreover, in certain embodiments, the air passages 86 may extend at least partially radially outward relative to the conductor pipe 62, while in other embodiments the air passages 86 may extend at least partially radially inward. Thereafter, the air 78 flows across the blades 90 extending radially outward from the outer diameter 84 of the conductor pipe 62, thereby reducing entrainment of filling fluid 60 within the air 78, as discussed above.

As will be appreciated, the disclosed embodiments may include various designs, configurations, or arrangements, all of which are within the scope and spirit of the present disclosure. For example, the filling tool 50 may be formed from a variety of materials, such as steel, aluminum, polymer, plastic, or other material. Additionally, the filling tool 50 may be formed as a single, integral piece (e.g., by a casting process), or the filling tool 50 may be formed by combining multiple pieces together (e.g., by a welding or brazing process). Furthermore, the diffuser block 66 may have various configurations. For example, the diffuser block 66 may include any suitable number of fluid passages 68, and therefore may have any suitable number of respective exit ports 72 and external passages 100 formed in the outer diameter 70 of the diffuser block 66. Similarly, the diffuser block 66 may have any suitable number of air passages 86 extending from the chamber 80 to the outer diameter 84 of the conductor pipe 62.

Additionally, the external passages 100 may have a variety of configurations or shapes to achieve a helical, vortex, or swirl flow pattern in the filling fluid 60 flow. For example, each of the external passages 100 may have a similar configuration (e.g., angle, contour, etc.) or the configuration of each of the external passages 100 may vary. For example, in some embodiments, the external passages 100 may be recesses formed in the outer diameter 70 of the diffuser block 66, and, in other embodiments, the external passages 100 may be enclosed passages. Moreover, the various features of the diffuser block 66 may be formed with a variety of forming and/or machining processes, such as milling, casting, drilling, honing, and so forth.

Furthermore, the blades 90 extending radially outward from the outer diameter 84 of the conductor pipe 62 may have a variety of configurations. For example, the blades 90 may be spaced equally or varyingly around the circumference of the conductor pipe 62, the blades 90 may be staggered relative to one another, the blades may have similar or varying pitches and/or contours, and so forth. In certain embodiments, the position and/or orientation of the blades 90 may be selected to achieve a desired vortex or cyclone flow pattern of the air 78 passing across the blades 90.

As discussed in detail above, embodiments of the present disclosure are directed toward the filling tool 50 for filling casing or other tubular 30 with the filling fluid 30. More specifically, during a filling process associated with running or landed tubular 30, the filling tool 50 may be used to increase the speed of filling the tubular 30 with the filling fluid 60. Additionally, the filling tool 50 may be configured to reduce aeration of the filling fluid 60 during the filling process and/or separate entrained filling fluid 60 from air 78 exiting the tubular 30 during the filling process. As discussed above, the filling tool 50 includes the conductor pipe 62 that flows filling fluid 60 to the diffuser block 66 of the filling tool 50. Thereafter, the diffuser block 66 generates a swirl, vortex, or other helical flow pattern in the filling fluid 60 with external passages 100 as the filling fluid 60 enters the tubular 30. In this manner, the filling fluid 60 may more completely travel downward against the inner diameter 74 of the tubular 30, thereby reducing aeration of the filling fluid 60 during the filling process. Additionally, the diffuser block 66 may include the chamber 80 configured to collect or gather air 78 exiting the tubular 30 during the filling process and direct the air 78 across blades 90 positioned about the conductor pipe 62. In the manner described above, the blades 90 may reduce entrained fluid (e.g., filling fluid 60) within the air 78 exiting the tubular 30 as the tubular 30 is filled with the filling fluid 60.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A tubular filling tool, comprising:

a conductor pipe configured to receive a filling fluid flow from a top drive; and a diffuser block communicatively coupled to the conductor pipe and configured to receive the filling fluid flow from the conductor pipe, wherein the diffuser block comprises a plurality of fluid passages extending to external passages formed in an outer diameter of the diffuser block and configured to facilitate passage of the filling fluid flow to the external passages from within the diffuser block, wherein the external passages are configured to generate a swirl flow pattern in the filling fluid flow during a tubular filling process, and each of the external passages comprises a helical shape extending about the outer diameter of the diffuser block, at least one of the external passages extending to a lower end of the diffuser block.

2. The tubular filling tool of claim 1, wherein the diffuser block is configured to be at least partially disposed within a tubular of a mineral extraction system during the tubular filling process.

3. The tubular filling tool of claim 2, wherein the tubular is casing landed in a wellbore of the mineral extraction system.

4. The tubular filling tool of claim 1, wherein a base of the diffuser block comprises a chamber that is opened toward an engagement area and configured to collect air displaced by the filling fluid flow during the tubular filling process.

5. The tubular filling tool of claim 4, wherein the diffuser block comprises a plurality of air passages extending from the chamber to an outer diameter of the conductor pipe.

6. The tubular filling tool of claim 1, comprising a plurality of blades extending radially outward from an outer diameter of the conductor pipe.

7. The tubular filling tool of claim 6, wherein the plurality of blades is arranged circumferentially about the outer diameter of the conductor pipe and spaced apart along a length of the conductor pipe.

8. The tubular filling tool of claim 1, wherein the tubular filling tool is disposed within a length of casing during the tubular filling process.

9. The tubular filling tool of claim 1, comprising the filling fluid flow including a flow of mud or water.

10. A method, comprising:

receiving a filling fluid into a filling tool of a mineral extraction system;

passing the filling fluid through a conductor pipe to a diffuser block;

generating a swirl flow pattern in the filling fluid with the filling tool by passing the filling fluid through fluid passages of the diffuser block and into external passages formed in an outer diameter of the diffuser block, at least one of the external passages extending to a lower end of the diffuser block, and wherein each of the external passages comprises a helical pattern extending about a longitudinal axis of the filling tool: and flowing the filling fluid into a tubular of the mineral extraction system.

11. The method of claim 10, wherein flowing the filling fluid into the tubular of the mineral extraction system comprises flowing the filling fluid against an inner diameter of the tubular.

12. The method of claim 10, comprising collecting air displaced by the filling fluid in the tubular with a chamber of the filling tool.

13. The method of claim 12, comprising receiving air from the chamber of the filling tool to an outer diameter of the filling tool through a plurality of air passages formed in the filling tool.

14. The method of claim 13, comprising directing the air across a plurality of blades extending radially outward from the filling tool to reduce entrained filling fluid in the air.

15. The method of claim 14, comprising collecting the entrained filling fluid and directing the entrained filling fluid into the tubular.

16. The method of claim 10, comprising disposing the filling tool within a length of casing and positioning the length of casing in axial abutment with the tubular.

17. A drilling system, comprising:

a tubular filling tool;

a conductor pipe of the tubular filling tool configured to receive a filling fluid from a filling fluid pump; and a diffuser block of the tubular filling tool coupled to the conductor pipe; a plurality fluid passages in the diffuser block communicatively extending from the conductor pipe to external passages formed in an outer diameter of the diffuser block, wherein the external passages are configured to generate a swirl flow pattern in the filling fluid during a tubular filling process and each of the external passages comprises a helical shape extending about a longitudinal axis of the tubular filling tool, at least one of the external passages extending to a lower end of the diffuser block; and a plurality of blades extending radially outward from the conductor pipe about a circumference of the conductor pipe and spaced along a length of the conductor pipe.

18. The drilling system of claim 17, comprising a length of casing disposed about the tubular filling tool.

19. The drilling system of claim 17, wherein the diffuser block comprises:

a chamber configured to collect air displaced by the filling fluid during the tubular filling process; and a plurality of air passages configured to direct the air from the chamber across the plurality of blades.

* * * * *